US005221601A

United States Patent [19]

Graindourze et al.

[11] Patent Number: 5,221,601

[45] Date of Patent: Jun. 22, 1993

[54] ROOMLIGHT HANDLEABLE UV SENSITIVE DIRECT POSITIVE SILVER HALIDE PHOTOGRAPHIC MATERIAL

[75] Inventors: Marc B. Graindourze, Overpelt; Marc H. Van Bockstaele, Mortsel, both of Belgium

[73] Assignee: Agfa-Gevaert, N.V., Mortsel, Belgium

[21] Appl. No.: 760,162

[22] Filed: Sep. 16, 1991

[30] Foreign Application Priority Data

Sep. 24, 1990 [EP] European Pat. Off. ..... 90202520.4

[51] Int. Cl.[5] ..... G03C 1/485

[52] U.S. Cl. ..... 430/597; 430/596; 430/613; 430/614; 430/603; 430/940

[58] Field of Search ..... 430/597, 596, 613, 614, 430/603, 411, 412, 940

[56] References Cited

U.S. PATENT DOCUMENTS 4,820,625 4/1989 Saeki et al. ..... 430/596

4,990,438 2/1991 Ogi et al. ..... 430/613

*Primary Examiner*—Charles L. Bowers, Jr.

*Assistant Examiner*—Thorl Chea

*Attorney, Agent, or Firm*—Breiner & Breiner

[57] ABSTRACT

UV sensitive direct positive silver halide photographic material for duplicating processes which can be safely handled under roomlight conditions, said material comprising a support having thereon at least one silver halide emulsion layer comprising a prefogged direct positive silver halide emulsion, preferably one having a chloride content of at least 70 mole % and comprising internal electron traps, said emulsion layer or a hydrophilic colloid layer in water-permeable relationship to said emulsion layer containing at least one nitro-substitued indazole or benzimidazole derivative and at least one non-nitro-substituted indazole or benzimidazole derivative.

6 Claims, No Drawings

ROOMLIGHT HANDLEABLE UV SENSITIVE DIRECT POSITIVE SILVER HALIDE PHOTOGRAPHIC MATERIAL

FIELD OF THE INVENTION

The present invention relates to a photographic material containing a prefogged direct positive silver halide emulsion. more particularly. to a direct positive silver halide photographic material safely handleable under roomlight conditions and having improved photographic direct positive reversal characteristics.

BACKGROUND OF THE INVENTION

In the sector of pre-press activity known as graphic and reprographic arts an intensive use is made of contact copying materials to produce screen dot images, line work and typesetting work. Both negative working photographic materials which produce negative-positive or positive-negative copies are used as well as so-called direct positive working materials giving rise to negative-negative or positive-positive reproductions.

In order to obtain exact copies with sharp dot and line edges, it is necessary to use fine-grained relatively insensitive photographic emulsions. The materials containing this type of emulsions are image-wise exposed in contact with the original in a graphic arts copying apparatus by means of high intensity radiation, preferably by light sources emitting a high content of near-ultraviolet light.

The handling of ever increasing amounts of photographic materials of different kinds, the decentralisation of the distinct steps in the reproduction cycle etc., have created a demand for silver halide materials which can be handled under clear ambient light illumination. This demand has given rise to the development of so called "roomlight materials" which can be image-wise exposed, handled and processed for a reasonable time while being illuminated by common office fluorescent tubes and daylight penetrating through office windows without the occurence of fogging of the negative emulsion or bleaching of the prefogged direct positive emulsion. The benefits of this include ease of working and inspection of the element during exposure and processing, and generally more pleasant working conditions for the operators. Prior art material which can be handled under roomlight conditions has been described in e.g. U.S. Pat. No. 2,219,667 and GB 1,330,044.

Silver halide emulsions contained in such roomlight materials should exhibit adequate sensitivity and other sensitometric characteristics for image-wise exposure while showing no photographic response under ambient light conditions. It is the task of the emulsion designer to establish the optimal compromise between these two conflicting characteristics.

Relatively sensitive direct positive emulsions can be composed of AgBr or AgBrI; in this case however red safety light conditions as present in classical darkrooms are required. Rather insensitive direct positive AgBr(I) emulsions which can be handled for short periods under bright light conditions can be obtained through the addition of a large amount of filter dyes although this often has a negative effect on the photographic sensitometric characteristics of the direct positive material such as a substantial decrease of the gradation. For roomlight direct positive applications it is therefor, like in the corresponding negative case, necessary to use emulsions with a high content of chloride so that there is a minimum overlap between the intrinsic sensitivity and the roomlight spectrum. Indeed, silver chloride emulsions show the advantage of a shorter spectral cut-off in the visible region.

However, for good reversal characteristics of a direct positive silver halide emulsion, particularly $D_{min}$, silverbromide is more desirable than silver chloride containing emulsions. Furthermore, because of the greater solubility of silver chloride than silver bromide in commonly used rapid access developers it is more difficult to obtain good reversal characteristics with AgX emulsions containing high amounts of chloride than it is with emulsions with low contents of chloride.

Photosensitive materials with direct positive silver halide emulsions providing low $D_{min}$ and which do not suffer from an increase of $D_{min}$ upon long-range storage, and further satisfying two contradictory requirements, one being to provide low $D_{min}$, and the other to have a satisfactory safelight aptitude, are very much desired in graphic arts.

Attempts to improve $D_{min}$ of direct positive silver halide emulsions have been described and are mostly based on an optimalization of the electron accepting system of the direct positive emulsions. Direct positive working emulsions can function according to internal and/or external electron trapping technology.

Internal electron trapping systems are described i.a. in "Chimie et Physique Photographique" by G.F. Glafkides, in "Photographic Emulsion Chemistry" by G.F.Duffin, in "Making and Coating Photographic Emulsion" by V.L.Zelikman et al, and in "Die Grundlagen der Photographischen Prozesse mit Silberhalogeniden" edited by H. Frieser and published by Akademische Verlagsgesellschaft (1968). As described in said literature internal electron trapping systems can be obtained through the presence of phase boundaries in the so.called core-shell emulsion type. A chemical sensitized core-shell type direct positive emulsion can be obtained through the chemical ripening of the AgX-.core. as is commonly applied for negative silver halide emulsions, followed by a shell-type silver halide precipitation. Inorganic desensitizers, e.g. metal dopants such as Ir, Rh, Ru, Pb, Cd, Hg, Tl, Pd, Pt, or Au can function as well as internal electron traps in the interior of the silver halide crystals. In these cases the emulsion surface can be fogged or not. In the latter case usually a reducing agent is present in the photographic material or in its developing solution, e.g. tin compounds as described in GB-A 789,823, amines, hydrazine derivatives, formamidine-sulphinic acids and silane compounds. Chemical sensitization can be carried out by effecting the ripening if performed in the presence of small amounts of compounds containing sulphur e.g. thiosulphate, thiocyanate, thioureas, sulphites, mercapto compounds and rhodamines or through the addition of gold-sulphur ripeners.

According to the principles of external electron trapping the emulsion surface is prefogged and an electron-accepting compound is adsorbed at it. Prior art concerning electron-accepting compounds suitable for use in direct positive emulsions, includes nitrostyryl and nitrobenzylidene dyes as described in U.S. Pat. No. 3,615,610, dihydropyrimidine compounds of the type disclosed in DE 2,237,036 and compounds of the type disclosed in U.S. Pat. No. 3,531,290. Other useful electron accepting compounds are cyanine and merocyanine dyes containing at least one nucleus, and preferably two nuclei with desensitizing substituents such as nitro groups, or dyes containing desensitizing basic nuclei as described in U.S. Pat. Nos. 2,930,644, 3,431,111, 3,492,123, 3,501,310, 3,501,311, 3,574,629, 3,579,345, 3,598,595, 3,592,653, and GB 1,192,384.

If however the absorption spectrum of an external electron-accepting agent would extend to the visible region, as it is e.g. the case with the well known electron-accepting agent Pinakryptol Yellow, this would lead under roomlight conditions to the bleaching of the developable specks created by the prefogging of the emulsion. Electron accepting compounds suitable for use in roomlight insensitive emulsions are disclosed respectively in US 4,820,625 and EU application number 90200646,9. These electron accepting compounds belong to the class of nitro-substituted phenyl thioether derivatives and nitro-substituted heterocyclic thioether derivatives, e.g. pyridine derivatives. In the later applications concerned with an insensitive direct positive roomlight material, the emulsion layer(s) preferably additionally contain(s) a ntroindazole or nitrobenzimidazole derivative, preferably a 5- or 6-nitroindazole or 5- or 6-nitrobenzimidazole. These organic compounds have proved to be very useful in further reducing the minimal density level if combined with the prescribed electron accepting compounds and to provide good storage properties.

It is an object of the present invention to provide a direct positive silver halide photographic material containing a prefogged direct positive silverchlorobromide emulsion, which can be handled in bright safelight conditions and which shows good reversal photographic characteristics, in particular, an adequately high maximim density and low minimum density, high contrast, no re-reversal effects and a stable sensitivity even after long-range storage.

Other objects will become apparent from the description hereinafter.

SUMMARY OF THE INVENTION

The objects of the present invention have been attained by providing a direct positive silver halide material comprising a support having thereon at least one prefogged direct positive silver halide emulsion layer comprising internal electron traps as referred to herebefore and having a chloride content of at least 70 mole %, said emulsion layer or a hydrophilic colloid layer in water-permeable relationship with said emulsion layer containing at least one compound represented by the following general formulae (I) or (II) and at least one compound represented by the following general formulae (III) or (IV):

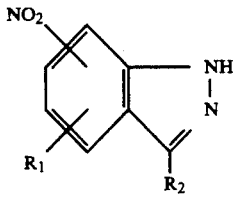

(I)

-continued

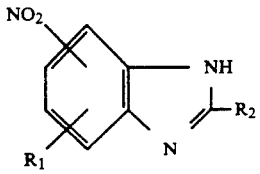

(II)

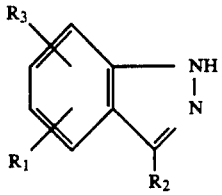

(III)

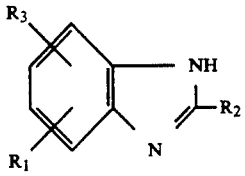

(IV)

wheren :

$R_1$ and $R_3$ each independently represent hydrogen, cyano, a halogen atom, substituted or unsubstituted alkyl, substituted or unsubstituted alkenyl, substituted or unsubstituted alkynyl, substituted or unsubstituted aryl, substituted or unsubstituted aralkyl, —$SO_3M$ or —COOM (wherein M represents a hydrogen atom, an alkali metal ion or an onium ion) or $R_1$ and $R_3$ together with the carbon atom to which they are attached represent the atoms necessary to complete a substituted or unsubstituted alicyclic or aromatic ring system. $R_2$ stands for hydrogen, substituted or unsubstituted alkyl, substituted or unsubstituted alkenyl, substituted or unsubstituted alkynyl, substituted or unsubstituted aryl, substituted or unsubstituted aralkyl.

DETAILED DESCRIPTION OF THE INVENTION

Specific examples of the compounds represented by the general formulae (I) (II), (III) or (IV) are listed in table 1. However, the present invention should not be construed as being limited to the given examples.

TABLE 1

| |
|---|
| Compounds represented by the general formula (I): |
| (I-1): 5-nitro-indazole |
| (I-2): 6-nitro-indazole |
| (I-3): 3-methyl-5-nitro-indazole |
| (I-4): 3-methyl-6-nitro-indazole |
| Compounds represented by the general formula (II): |
| (II-1): 5-nitro-benzimidazole |
| (II-2): 6-nitro-benzimidazole |
| Compounds represented by the general formula (III) |
| (III-1): indazole |
| (III-2): 3-methyl-indazole |
| (III-3): 5-chloro-indazole |
| (III-4): 5-cyano-indazole |
| Compounds represented by the general formula (IV): |
| (IV-1): benzimidazole |
| (IV-2): 2-methyl-benzimidazole |
| (IV-3): 2-propyl-benzimidazole |

The direct positive silver halide photographic material of the present invention should contain at least one compound represented by the general formulae (I) or (II) and at least one compound represented by the general formulae (III) or (IV) in the silver halide emulsion layer or a hydrophilic layer adjacent in water-permeable relationship therewith. The compounds (III) or (IV) may be contained in the same or different layer with the compounds (I) or (II), preferably both are added to the silver halide emulsion layer. The compounds (I) or (II) are preferably incorporated in an amount of $10^{-5}$ to $10^{-1}$ mole, particularly preferably $10^{-4}$ to $10^{-2}$ mole, per mole of total silver halide. The compounds (III) or (IV) are preferably incorporated in an amount of $10^{-5}$ to $10^{-1}$ mole, particularly preferably $10^{-4}$ to 5 $10^{-1}$ mole, per mole of total silver halide.

All compounds can be added to a silver halide emulsion at any stage of the emulsion-making. The compounds are preferably added to the emulsion after the completion of the fogging process and particularly preferably added to the composition prepared for coating.

The silver halide emulsion can be present in a single layer or in a multilayer pack, e.g., a double layer.

The photographic emulsions can be prepared from soluble silver salts and soluble halides according to different methods as described e.g. by P. Glafkides in "Chimie et Physique Photographique", Paul Montel, Paris (1967), by G.F. Duffin in "Photographic Emulsion Chemistry", The Focal Press, London (1966), and by V.L. Zelikman et al in "Making and Coating Photographic Emulsion", The Focal Press, London (1966) as mentioned above.

The photographic silver halide emulsions used according to the present invention may be produced by mixing the halide and silver solutions in partially or fully controlled conditions of temperature, concentrations, sequence of addition, and rates of addition. The silver halide can be precipitated according to the single-jet method, the double-Jet method, or the conversion method.

The emulsion can be desalted in the usual ways e.g. by dialysis, by flocculation and re-dispersing, or by ultrafiltration. As handling under bright safelight is required the halide composition of the silver halide emulsions used according to the present invention is a silver chlorohalide emulsion having a high chloride content. Any silver halides containing chloride in an amount of at least 70 mole %, e.g., silver chloride, silverchlorobromide, silverchlorobromoiodide, etc., may be employed. Especially silver chlorobromide having a chloride content of 90 mole % or more is preferred over others. A very low content of iodide 1-2 mole %) may be present in the silver halide.

The emulsions are preferably provided with inorganic electron accepting compounds added during grain formation as a primary electron trapping system. Such compounds are preferably the salts and complex salts of a Group VIII element of the periodic table, e.g. addition of $Rh^{3+}$ions as sodium hexachlororhodate. These inorganic compounds eliminate or reduce the amounts of surface electron accepting compounds which could degrade the safelight tolerance by extending the spectral sensitivity more into the visible region. The dopants are used in a concentration ranging from $10^{-6}$ to $10^{-2}$ mole preferably from 5 $10^{-6}$ to 5 $10^{-4}$ mole per mole of silver halide. In addition to the internal electron traps the emulsion can comprise external electron traps as referred to herebefore.

Two or more types of silver halide emulsions that have been prepared differently can be mixed for forming a photographic emulsion for use in accordance with the present invention. The emulsion of the invention may be coated on one or both sides of the support.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms. In the present invention silver halide particles having a cubic habit are preferred.

The average size of the silver halide grains may range from 0.01 to 2 microns, preferably from 0.05 to 0.4 microns. The size distribution of the silver halide particles of the photographic emulsions to be used according to the present invention can be homodisperse or heterodisperse. A homodisperse size distribution is obtained when 90%, preferably 95%, of the grains have a size that does not deviate more than 40%, preferably 20%, from the average grain size.

The surface of the silver halide grains of the direct positive emulsions to be used in the present invention is preferably prefogged in a conventional way using a reducing agent with or without a metal compound which is electrically more positive than silver, such as gold, rhodium, platinum and iridium salts. Fogging can also occur without adding any particular substance but by simply using reducing conditions of pH and pAg.

Useful examples of reducing agents include thiourea dioxide, formaldehyde, a polyamine (e.g. triethylenetetramine, telraethylenepentamine, etc.), hydrazine, boron containing compounds (e.g., an azineborane boro. hydride compound), stannous chloride, stannic chloride and the like. Typical examples of useful metal compounds which are electrically more positive than silver include soluble salts of gold, rhodium, platinum, palladium, iridium and the like, more specifically potassium chloroaurate, chloroauric acid, ammonium chloropalladate and so on.

The fogging degree of the prefogged direct positive silver halide emulsion to be employed in the present invention can be subject to a wide range of change. The fogging degree, as is well known to one skilled in the art, depends not only on the halide composition, the grain size and other attributes of the silver halide emulsion used, but also on the kind and concentration of the fogging agent used, the pH and pAg values of the emulsion at the time of receiving the fogging treatment, the fogging temperature, time and so on.

Besides the silver halide another essential component of a light-sensitive emulsion layer is the binder. The binder is a hydrophilic colloid, preferably gelatin. Gelatin can, however, be replaced in part or integrallly by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

The binder should dispose of an acceptably high number of functional groups, which by reaction with an appropriate hardening agent can provide a sufficiently resistant layer. Such functional groups are especially the amino groups, but also carboxylic groups, hydroxy groups, and active methylene groups.

The gelatin can be lime-treated or acid-treated gelatin. The preparation of such gelatin types has been described in e.g. "The Science and Technology of Gelatin", edited by A.G. Ward and A. Courts, Academic Press 1977, page 295 and next pages. The gelatin can also be an enzyme-treated gelatin as described in Bull. Soc. Sci. Phot. Japan, N. 16, page 30 (1966).

The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, and development acceleration or inhibition.

The photographic element of the present invention may further comprise various kinds of commonly used photographic additives such as e.g. compounds improving the dimensional stability of the photographic element, antistatic agents, UV-absorbers, brightening agents, antiseptic agents, spacing agents, matting agents, plasticizers and compounds stabilizing the photographic characteristics during the production or storage of photographic elements or during the photographic treatment thereof.

Suitable additives for improving the dimensional stability of the photographic element are i.a. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

In general, the average particle size of spacing agents is comprised between 0.2 and 10 microns. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Examples of stabilizers which can be added to the emulsion include triazoles, azaindenes, quaternary benzothiazolium compounds, mercapto compounds or a water-soluble inorganic salt of, e.g. cadmium, cobalt, nickel, manganese, gold, thallium, zinc, and so on as described by Birr in Z. Wiss. Phot. 47 (1952), pages 2–58.

Beside the light sensitive emulsion layer(s) the photographic material can contain several non-light sensitive layers, e.g. an anti-stress top layer, one or more backing layers, and one or more intermediate layers eventually containing filter- or antihalation dyes that absorb scattering light and thus promote the image sharpness.

The direct positive silver halide photographic material of the present invention may also contain so called filter dyes to permit handling the light sensitive material under an ultraviolet rays-free fluorescent lamp. Suitable dyes for the improvement of safelight aptitude are described in i.a. US 4,092,168, U.S. Pat. No. 4,311,787, DE 2,453,217, and GB 7,907,440.

One or more backing layers can be provided at the non-light sensitive side of the support. This layers which can serve as anti-curl layer can contain i.a. matting agents e.g. silica particles, lubricants, antistatic agents, light absorbing dyes, opacifying agents, e.g. titanium oxide and the usual ingredients like hardeners and wetting agents.

The support of the direct positive photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene terephthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The development of the exposed direct positive silver halide emulsions of the invention may occur in alkaline solutions containing conventional developing agents or combinations of developing agents that have a supperadditive action. The developing solution may be a so-called lithographic developer, which contains sulfite ions in a low concentration, or a developer containing sulfite ions as a preservative in a sufficiently high concentration (particularly above 0.15 mole/1). Also a developing solution adjusted to pH 9.5 or above, particularly to pH 10.5–12.3, can be employed.

The developing agent which can be used in the method of the present invention has no particular restriction. For example, dihydroxybenzenes (such as hydroquinone), 3-pyrazolidones (such as 1-phenyl-3-pyrazolidone, 4,4-dimethyl-1-phenyl-3-pyrazolidone, etc.) aminophenols (such as N-methyl-p-and so on can be employed alone or in combination of two or more.

The developing solution which can be employed in the present invention can additionally contain pH buffering agents, such as sulfites, carbonates, borates or phosphates of alkali metals, a development inhibitor or antifoggant, such as a bromide, an iodide or an organic antifoggant, and so on. Further, a hard water softener, a dissolving aid, a toning agent, a development accelerator, a surface active agent, a defoaming agent, a hardener, an agent for preventing silver stain and so on may be present in the developing solution if desired The fixing solution which can be used is any of those commonly used. Therein, not only thiosulfates and thiocyanates but also organic sulphur compounds known to have a fixing effect can be used as a fixing agent.

The photographic material can be exposed to any usual light source for roomlight materials, e.g. mercury vapour lamps, metal-halogen lamps, xenon tubes, pulsed xenon tubes and quartz-halogen sources.

EXAMPLES

The present invention will be illustrated further in detail by reference to the following examples but the scoop of this invention is not limited to and by these examples.

EXAMPLE 1

A direct positive silver chlorobromide roomlight emulsion consisting of 95 mole % of chloride and 5 mole % of bromide was prepared by a double Jet precipitation technique, resulting in an average grain size of 0.2 microns. During precipitation the emulsion was doped with $Rh^{3+}$ions using 1.25 $10^{-5}$ mole sodium hexachlororhodate per mole of silver halide. The emulsion was conventionally fogged with 1.0 $10^{-4}$ mole of thioureadioxide and 1.25 $10^{-6}$ mole of chloroauric acid per mole of silver halide. The emulsion was divided in aliquot portions and to each portion 5-nitrobenzimidazool (Compound II-I) was added as listed in table 1. An indazole derivative according to the general formula (III) was added in the amounts indicated in table 2.

After coating at 5.5 g of $AgNO_3/m^2$ using conventional coating additives the emulsion layers were exposed through a step wedge by a 1000 Watt quartzhalogen lamp. Then the materials were developed for 21 seconds at 37° C. in a developer solution (I) of the following composition:

| Developer solution (I): | |
|---|---|
| trisodium phosphate | 60 g |
| sodium sulphite anh. | 60 g |
| hydrochinon | 40 g |
| N-methyl-p-aminofenol sulphate | 2.5 g |
| potassium bromide | 4 g |
| 5-methyl-benzotriazol | 0.3 g |
| 3-diethylamino-1,-propaandiole | 20 g |
| water to make | 1 l |
| pH adjusted to 11.5 | |

Following development the materials were fixed in a conventional ammoniumthiosulphate containing fixer, rinsed and dried.

The results of the photographic evaluation are presented in table 2.

TABLE 2

| Compound II | Conc. $\times 10^{-3}$ (1) | Compound III | Conc. $\times 10^{-3}$ (1) | Sensitometry Dmin | Dmax | S (2) |
|---|---|---|---|---|---|---|
| II-1 | 6.0 | — | — | 0.10 | 5.9 | 100 |
| II-1 | 6.0 | III-3 | 6.0 | 0.05 | 5.8 | 107 |
| II-1 | 6.0 | III-3 | 18 | 0.03 | 5.0 | 131 |
| II-1 | 4.8 | — | — | 0.08 | 5.8 | 98 |
| II-1 | 4.8 | III-3 | 6.0 | 0.05 | 5.7 | 100 |
| II-1 | 4.8 | III-3 | 18 | 0.03 | 5.2 | 121 |

notes:
(1): expressed as mole per mole of silver halide;
(2): sensitivity determined at density 2.0 expressed as a relative value compared to the sensitivity of the sample not containing compound III to which a value of 100 has been given; higher values mean higher sensitivity.

Table 2 illustrates the effective reduction of the minimal density by combining a nitro-substituted benzimidazole derivative with a non-nitrosubstituted indazole according to the present invention for direct positive roomlight materials.

EXAMPLE 2

A similar direct positive silver chlorobromide roomlight emulsion as described in example 1 is used in the following examples. Only a higher amount of $Rh^{3+}$was used during precipitation of the emulsion by the addition of 2.5 $10^{-5}$ mole sodium hexachlororhodate per mole of silver halide. The added indazole and/or benzimidazole derivates are listed in table 3. The resulting samples are treated analogously with the developer solution (I) as in example 1. The results of the photographic evaluation are presented in table 3.

TABLE 3

| Compound (I or II) | Conc. $\times 10^{-3}$ (1) | Compound IV | Conc. $\times 10^{-3}$ (1) | Sensitometry Dmin | Dmax | S (2) | Roomlight safety (3) |
|---|---|---|---|---|---|---|---|
| II-1 | 6.0 | — | — | 0.14 | 5.8 | 100 | 20 |
| II-1 | 6.0 | IV-1 | 8.0 | 0.05 | 5.3 | 101 | 20 |
| II-1 | 6.0 | IV-1 | 16 | 0.05 | 5.6 | 106 | 20 |
| I-1 | 6.0 | — | — | 0.09 | 5.9 | 100 | 30 |
| I-1 | 6.0 | IV-1 | 4.0 | 0.06 | 5.5 | 102 | 30 |

TABLE 3-continued

| Compound (I or II) | Conc. $\times 10^{-3}$ (1) | Compound IV | Conc. $\times 10^{-3}$ (1) | Sensitometry Dmin | Dmax | S (2) | Roomlight safety (3) |
|---|---|---|---|---|---|---|---|
| I-1 | 6.0 | IV-1 | 12 | 0.06 | 5.7 | 100 | 30 |

notes:
(1): expressed as mole per mole of silver halide;
(2): sensitivity determined at density 2.0 expressed as a relative value compared to the sensitivity of the sample not containing compound IV and to which a value of 100 has been given; higher values mean higher sensitivity;
(3): roomlight safety in minutes without loss of Dmax when exposed to UV-free visible light of 250 lux by a fluorescent lamp encapsulated with a UV-cut-off filter (cut-off = 410 nm).

Additionally to the effective reduction of the minimal sensitometric density by combining a nitro-indazole or benzimidazole derivative with a non-nitrobenzimidazole derivative table 3 illustrates the good manageability of the direct positive material under UV-free white light office conditions.

EXAMPLE 3

Example 3 has been performed analogously to example 2. To each sample 6.0 $10^{-3}$ mole of 5-nitro-benzimidazole (compound II-I) per mole of silver halide and a non-nitro-benzimidazole derivative according to the general formula (IV) was added in different amounts. The obtained results are listed in table 4.

TABLE 4

| Compound IV | Conc. $\times 10^{-3}$ (4) | Sensitometry (1) Dmin | Dmax | S (5) | Sensitometry (2) Dmin | Dmax | S (5) | Sensitometry (3) Dmin | Dmax | S (5) |
|---|---|---|---|---|---|---|---|---|---|---|
| — | — | 0.22 | 5.6 | 100 | 0.17 | 5.6 | 98 | 0.16 | 5.6 | 102 |
| IV-1 | 0.8 | 0.10 | 5.6 | 100 | 0.09 | 5.6 | 98 | 0.12 | 5.6 | 102 |
| IV-1 | 2.0 | 0.06 | 5.7 | 98 | 0.06 | 5.6 | 97 | 0.07 | 5.6 | 102 |
| IV-1 | 4.0 | 0.05 | 5.7 | 98 | 0.05 | 5.5 | 97 | 0.05 | 5.5 | 102 |
| IV-2 | 0.7 | 0.13 | 5.7 | 96 | 0.11 | 5.7 | 96 | 0.10 | 5.6 | 100 |
| IV-2 | 1.75 | 0.07 | 5.6 | 95 | 0.07 | 5.5 | 97 | 0.08 | 5.6 | 99 |
| IV-2 | 3.5 | 0.05 | 5.7 | 96 | 0.05 | 5.5 | 98 | 0.06 | 5.6 | 100 |

notes:
(1): fresh sensitometry;
(2): after 3 days of storage at 57° C. and 34% R.H.;
(3): after 3 days of storage at 35° C. and 80% R.H.;
(4): expressed as mole per mole of silver halide;
(5): sensitivity determined at density 2.0 expressed as a relative value compared to the sensitivity of the fresh sample not containing compound IV and to which a value of 100 has been given; higher values mean higher sensitivity.

Table 4 illustrates that the $D_{min}$ value is retained even upon storage under high humidity and/or high temperature conditions when a nitro- and a non-nitro-substituted benzimidazole compound is added to the direct positive emulsion.

We claim:

1. Photographic direct positive silver halide material which can be safely handled under roomlight conditions, said material comprising a support having thereon at least one silver halide emulsion layer comprising a prefogged direct positive silver halide emulsion, the silver halide consisting of at least 70 mole % of silver chloride and comprising internal electron traps, characterized in that said emulsion layer or a hydrophilic colloid layer in water-permeable relationship with said emulsion layer contains at least one nitro-substituted indazole derivative or nitro-substituted benzimidazole derivative and at least one non-nitro-substituted indazole derivative or nitro-substituted benzimidazole derivative.

2. Photographic direct positive silver halide material according to claim 1 wherein the nitro-substituted indazole and nitro-substituted benzimidazole compounds correspond to the following general formulae (I) or (II) and the non-nitro-substituted indazole and non-nitro-substituted benzimidazole derivatives correspond to the general formulae (III) or (IV):

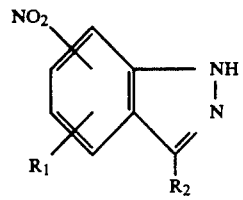

(I)

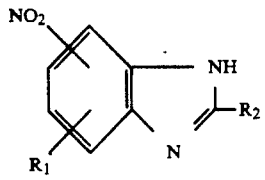

(II)

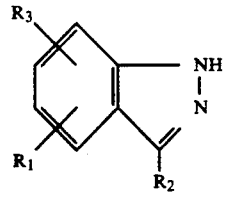

(III)

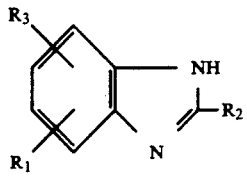

(IV)

wherein:

$R_1$ and $R_3$ each independentaly represent hydrogen, cyano, a halogen atom, substiuted or unsubstituted alkyl, substituted or unsubstituted alkenyl, substituted or unsubstituted alkynyl, substituted or unsubstitited aryl, substituted or unsubstituted aralkyl, —$SO_3M$ or —COOM (wherein M represents a hydrogen atom, an alkali metal ion or an onium ion) or $R_1$ and $R_3$ together with the carbon atoms to which they are attached represent the atoms necessary to complete a substituted or unsubstituted fused-on alicyclic or aromatic ring system. R2 stands for hydrogen. substituted or unsubstituted alkyl. substituted or unsubstituted alkenyl substituted or unsubstituted alkynyl substituted or unsubstituted aryl substituted or unsubstituted aralkyl.

3. Photographic material according to claim 1 wherein said emulsion is internally doped with an element of Group VIII of the periodic table.

4. Photographic material according to claim 3 wherein the element of Group VIII of the periodic table is Rhodium.

5. Photographic material according to claim 1 wherein the nitro-substituted indazole or nitro-substituted benzimidazole derivate is present in a concentration range from $10^{-5}$ to $10^{-1}$ mole per mole of silver halide.

6. Photographic material according to claim 1 wherein the non-nitro-substituted indazole or non-nitro-substituted benzimidazole derivate is present in a concentration range from 10.5 to 10.1 mole per mole of silver halide.

* * * * *